US007647222B2

(12) United States Patent
Dimkovic et al.

(10) Patent No.: US 7,647,222 B2
(45) Date of Patent: Jan. 12, 2010

(54) APPARATUS AND METHODS FOR ENCODING DIGITAL AUDIO DATA WITH A REDUCED BIT RATE

(75) Inventors: Ivan Dimkovic, Karlsruhe (DE); Gian Carlo Pascutto, Oudenaarde (BE)

(73) Assignee: Nero AG, Karlsbad (DE)

( * ) Notice: Subject to any disclaimer, the term of this patent is extended or adjusted under 35 U.S.C. 154(b) by 179 days.

(21) Appl. No.: 11/739,562

(22) Filed: Apr. 24, 2007

(65) Prior Publication Data

US 2007/0276661 A1 Nov. 29, 2007

Related U.S. Application Data

(63) Continuation of application No. PCT/EP2006/009601, filed on Oct. 4, 2006.

(60) Provisional application No. 60/745,499, filed on Apr. 24, 2006.

(51) Int. Cl.
*G10L 19/00* (2006.01)

(52) U.S. Cl. ..... 704/222; 704/230; 704/501; 381/23

(58) Field of Classification Search ..... 704/222, 704/230, 501; 381/23
See application file for complete search history.

(56) References Cited

U.S. PATENT DOCUMENTS 5,805,770 A * 9/1998 Tsutsui ..... 701/224
7,151,802 B1 * 12/2006 Bessette et al. ..... 375/259
7,447,631 B2 * 11/2008 Truman et al. ..... 704/230
2003/0028381 A1 * 2/2003 Tucker et al. ..... 704/273
2003/0233234 A1 12/2003 Truman et al.
2007/0094027 A1 * 4/2007 Vasilache ..... 704/257
2007/0136055 A1 * 6/2007 Hetherington ..... 704/227

OTHER PUBLICATIONS

3RD Generation Partnership Project; Technical Specification Group Services and Systems Aspects; General Audio Codec Audio Processing functions; Enhanced aacPlus general audio codec; Encoder Specification AAC part (Release 6); 3GPP TS 26.403 V6.0.0 3GPP, Sep. 2004.
Herr J. et al. Extending the MPEG-4AAC Codec by Perceptual Noise Substitution. AES Convention 1998.
Painter, et al.; "Perceptual Coding of Digital Audio"; Apr. 2000; Proceedings of the IEEE, vol. 88, No. 4, pp. 451-513.
Brandenburg, K.; "MP3 and AAC Explained"; 1999; AES 17th Intl Conf. on High Quality Audio Coding, pp. 1-12.

* cited by examiner

*Primary Examiner*—Daniel D Abebe
(74) *Attorney, Agent, or Firm*—Michael A. Glenn; Glenn Patent Group

(57) ABSTRACT

A method and an apparatus for encoding digital audio data with reduced bit rates, the apparatus having a provider of psycho-acoustically quantized digital audio data with a bit rate being higher than the reduced bit rate. The apparatus further has an identifier for identifying a frequency band according to a selection criterion, the selection criterion being such that an impact on the quality of the digital audio data when the data in the identified frequency band is replaced by generated noise is smaller than the impact on the quality of the digital audio data, which would arise when the data in a different frequency band is replaced by generated noise. The apparatus further has a replacer for replacing data in the identified frequency band of the digital audio data by a noise synthesis parameter.

11 Claims, 8 Drawing Sheets

APPARATUS AND METHODS FOR ENCODING DIGITAL AUDIO DATA WITH A REDUCED BIT RATE

CROSS-REFERENCE TO RELATED APPLICATIONS

This application is a continuation of copending International Application No. PCT/EP2006/009601, filed Oct. 4, 2006, which designated the United States, and is incorporated herein by reference in its entirety.

In addition, this application claims priority from U.S. Provisional Application No. 60/745,499, filed Apr. 24, 2006, and is incorporated herein by reference in its entirety.

TECHNICAL FIELD

The present invention relates to the field of encoding digital audio data, utilizing lossy compression algorithms as for example advanced audio coding in order to achieve lower bit rates, while keeping high audio data quality.

BACKGROUND

Modern digital lifestyle has much to thank to the principle of perceptual digital audio compression, such as MPEG-4AAC (MPEG=Moving Pictures Expert Group, AAC=Advanced Audio Coding) or MP3 (MPEG layer 3). Typical state of the art audio compression systems utilize time-to-frequency transform functions, such as, for example, the modified discrete cosine transform (MDCT) sub-dividing the signal in frequency bands that are formed of pluralities of spectral coefficients and quantization of these grouped coefficients with appropriate quantization algorithms, followed by an advanced coding of those coefficients with some entropy coding methods as, for example, Huffman coding.

The modified discrete cosine transform is a Fourier-related transform with the additional property of being lapped, i.e. it is designed to be performed on consecutive blocks of a larger dataset, where subsequent blocks are overlapped so that the last half of one block coincides with the first half of the next block. This overlapping, in addition to the energy-compaction qualities of the discrete cosine transform, makes the modified discrete cosine transform especially attractive for signal compression applications, since it helps to avoid artifacts stemming from block boundaries. Thus, a modified discrete cosine transform is, for example, employed in MP3 and AAC.

Unfortunately, at very low bit rates, i.e. at high compression demands, coding systems have no options, but to shut down frequency bands, i.e. replace them with silence. This method is utilized in order to meet the coding demands imposed to the codec. This introduces holes in the spectrum that are especially annoying and they are the biggest contributor to audio coding artifacts.

FIG. 8 shows a typical state of the art audio encoder for an input signal that is PCM (Pulse Code Modulation) encoded and input to a filter bank 810 and a perceptual model 815. The input signal is transformed from the temporal or time domain to the frequency domain by the filter bank 810, which is usually based on well known signal transform functions, such as the modified discrete cosine transform. The outputs of the filter bank are frequency coefficients.

At the same time the signal is evaluated by the perceptual model 815, the perceptual model evaluates the input signal by mathematically modeling the human auditory system and outputs a measure, such as for example the just noticeable distortion (JND) in units of a signal-to-mask ratio (SMR) of the input signal energy to the just noticeable distortion or noise energy.

The perceptual model block 815 and the remaining blocks in the state of the art encoder, as it is depicted in FIG. 8, treat the output of the filter bank block 810 proportionally to the critical bandwidths of the human auditory system, for example, by a grouping of the frequency coefficients in so-called scaling factor bands. A good summary of the perceptual model can be found in T. Painter and A. Spanias, "Perceptual Coding of Digital Audio", in the proceedings of the IEEE, pp. 451-513, April 2000.

The target compression demand is met by quantization of the frequency coefficients. Before quantization, the coefficients are scaled by so-called scaling factors to determine the eventual precision of the quantization process. The bit/noise allocation block 820 is responsible for estimation or calculation of the scaling factors, so the reconstruction of the quantized values yields quantization noise just below the masking threshold estimated by the perceptual model. Under certain circumstances, the perceptual model 815 indicates that certain frequency bands are noise-like and may be modeled by generating noise with a certain energy on the decoder side. For these frequency bands, there is no need to determine scaling factors or frequency coefficients, but parameters for a noise generator at the decoder side are inserted instead. Since the parameters for the noise generator take up less amount of data than scaling factors and frequency coefficients, data rates can be saved by replacing frequency bands with generated noise. The impact of the replacement on the quality of the decoded audio signal is kept in boundaries, determined by the perceptual model. For example, a frequency band, which is to be replaced, must not exceed a certain tonality threshold, nor does it contain any transient signal. The thresholds that determine noise substitution depend on the perceptual model. In ISO/IEC 14496, for example, perceptual noise substitution as a feature of AAC is described.

An advanced coding method used in some perceptual codecs is the so-called perceptual noise substitution (PNS) of which a good summary can be found in Herrer, Jürgen, Schultes, Donald, "Extending the MPEG-4AAC Codec by Perceptual Noise Substitution", AES document 4720.

After the bit allocation block 820 in FIG. 8, quantization is done in the quantization block 825, yielding quantized frequency coefficients, which are brought to the irrelevancy reduction block 830. The irrelevancy reduction block 830 employs signal irrelevance reduction methods, which are well known from signal theory. For example, Huffman coding, vector quantization or arithmetic coding are well known methods for signal irrelevancy reduction. An overview of these methods can, for instance, be found in K. Brandenburg, "MP3 and AAC Explained" in proceedings of the AES 17$^{th}$ International Conference on High-Quality Audio Coding, 1999.

In order to achieve the target coding requirements, for example, a given bit rate for the compressed signal, state of the art codecs are able to reduce the coding requirements by increasing the allowed amount of noise specified by the psycho-acoustic model or perceptual model. Referring to FIG. 8, the coding requirement is verified in block 835 and if the coding requirement is not met, the bit demand is further reduced in the reduction block 840, upon which the encoding algorithm returns to the bit/noise allocation block 820. If the coding requirement is achieved, a bit stream multiplexer block 845 multiplexes the coded quantized frequency coefficients and the coded scaling factors into a coded bit stream.

If the coding requirement is not met and the bit demand is further reduced, additional noise is introduced to the signal. As allowed noise is increased, the scaling factors are increased as well and resolution of the quantized signal is decreased, which then also decreases the bit demand. The quantization resolution can be decreased up to the point when noise gets greater than the signal itself, possibly meaning the output of the quantization block for that scaling factor will be zero. This effectively inserts a hole in the spectrum in the place where the signal of the scaling factor should be present. This operation can be iteratively repeated as long as the transmission/storing demand of the coded quantized coefficient is below the constraints imposed to the encoder. This operation always terminates successfully, even if it sets all quantized outputs to zero, cf. the flowchart in FIG. 8.

While, with the above-described state of the art method the coding requirements are effectively maintained and it functions quite well, provided that the constraints opposed to the codec are achievable without eliminating too much of scaling factors in the constraint's reduction phase, the method could fail miserably if the coding demands are set to be too high for the encoder.

This usually happens if the bit rate required is well below the requirements of the perceptual model. Non-optimized codecs would usually introduce high amounts of holes due to the shut-down of too much scaling factors in order to meet the coding constraints. Spectral holes or shut-downs are usually easily detectable by listeners and they have a huge impact on degradation of the sound quality. Signals containing spectral holes are usually classified as ringing, a swishy sound, birdies, etc.

Optimized state of the art codecs, as they can, for example, be found in 3GPP (3GPP=Third Generation Partnership Project), TS (TS=Technical Specification) 26.403, employ more advantageous strategies of coding constraints reduction, usually called hole avoidance. This strategy works by imposing maximum constraint reduction limits for each scaling factor. This ensures that no holes would be introduced in the scaling factors as long as it would be possible to reduce coding constraints for all scaling factors without violating this limit and maintaining the constraints imposed to the encoder. However, even with this advanced strategy, it is quite possible that the coding constraints will not be met and, in this case, the encoder will have no other option, but to start introducing spectral holes by eliminating scaling factors.

FIG. 9 shows spectrum plots of two codec signals, in the range of 100 Hz to 15 kHz. The codecs displayed are 32 kbps, which corresponds to a 44:1 compression ratio and 320 kbps, which corresponds to a 4.4:1 compression ratio. As it can easily be seen from FIG. 9, the 32 kbps codec was forced to introduce spectral holes in order to meet a coding demand and it can be seen by severe degradations in the upper frequency range.

SUMMARY

According to an embodiment, an apparatus for encoding digital audio data with a reduced bit rate may have a provider of psycho-acoustically quantized digital audio data with a bit rate being higher than the reduced bit rate and an identifier for identifying a frequency band according to a selection criterion, the selection criterion being such that an impact on the quality of the digital audio data when the data in the identified frequency band is replaced by the generated noise is smaller than the impact on the quality of the digital audio data, which would arise when data in a different frequency band is replaced by generated noise. The apparatus further may further have a replacer for replacing data in the identified frequency band of the digital audio data by a noise synthesis parameter, the noise synthesis parameter requiring a smaller amount of data than the data in the identified frequency band, the digital audio data having the reduced bit rate.

According to another embodiment, a method for encoding digital audio data with a reduced bit rate may have the steps of providing psycho-acoustically quantized digital audio data with a bit rate being higher than the reduced bit rate and identifying a frequency band according to a selection criterion and the selection criterion being such that an impact on a quality of the digital audio data when the data in the identified frequency band is replaced by the generated noise is smaller than the impact on the quality of the digital audio data, which would arise when a data in a different frequency band is replaced by generated noise. The method may further have the step of replacing data in the identified frequency band of the digital audio data by a noise synthesis parameter, the noise synthesis parameter requiring a smaller amount of data than the data in the identified frequency band, the digital audio data having the reduced bit rate.

According to another embodiment, a computer program may have program codes for performing the method mentioned above when the program code runs in a computer.

The present invention is based on the finding that since the human auditory system is not able to distinguish between different kinds of narrow band signals and noise signals as long as the average energy is the same or comparable. Under some circumstances, where high data compression is needed, the quality of digital audio data can be preserved more effectively if noise generators are used instead of shutting down frequency bands completely. This effectively means that it is sufficient to generate noise at the decoder stage without the need for transmitting a quantized spectral coefficient of the scale factor band, which is found to be noise-like. The only information that needs to be transmitted is the average energy value or a noise generator parameter as, for example, a noise synthesis parameter, of the scale factor band, which some codecs, such as MPEG-4AAC transmits instead of scaling factor values for such bands if the perceptual model indicates its suitability. However, if higher compression rates are required, these codecs shut down frequency bands where further introduction of generated noise yields a better quality of the digital audio data.

BRIEF DESCRIPTION OF THE DRAWINGS

Embodiments of the present invention will be described using the FIGS. attached in which.

DETAILED DESCRIPTION

Figure 1:
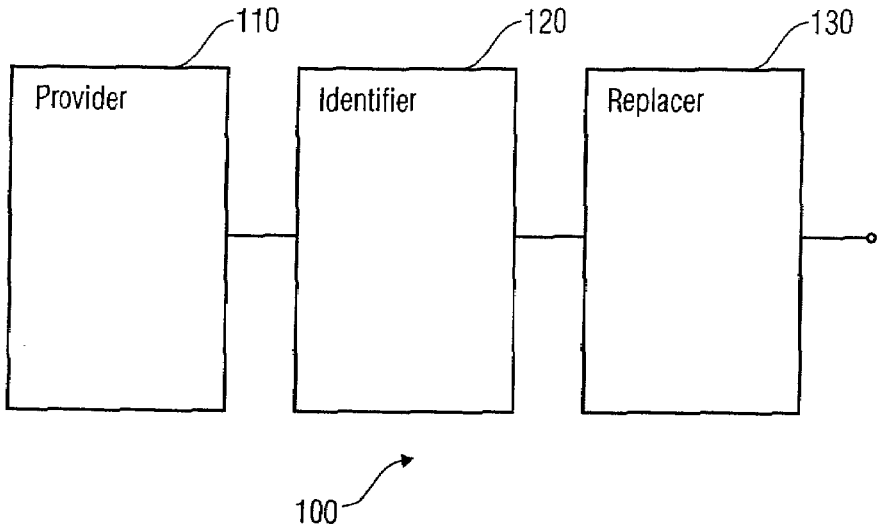
FIG. 1 shows a block diagram of an embodiment of an apparatus for encoding digital audio data.

An embodiment of an apparatus 100 for encoding digital audio data with reduced bit rate is depicted in FIG. 1. The embodiment depicted in FIG. 1 comprises a provider 110, which provides psycho-acoustically quantized digital audio data of a bit rate being higher than the reduced bit rate to an identifier 120. The identifier 120 identifies a frequency band according to a selection criterion, the selection criterion being such that an impact on the quality of the digital audio data when the data in the identified frequency band is replaced by generated noise is smaller than the impact on the quality of the digital audio data, which would arise when data in a different frequency band is replaced by generated noise. The identifier 120 indicates the identified frequency band to a replacer 130. The replacer 130 replaces data in the identified frequency band of the digital audio data by a noise synthesis parameter, the noise synthesis parameter requiring a smaller amount of data than the data in the identified frequency band, so that the digital audio data has a reduced bit rate.

Figure 2:
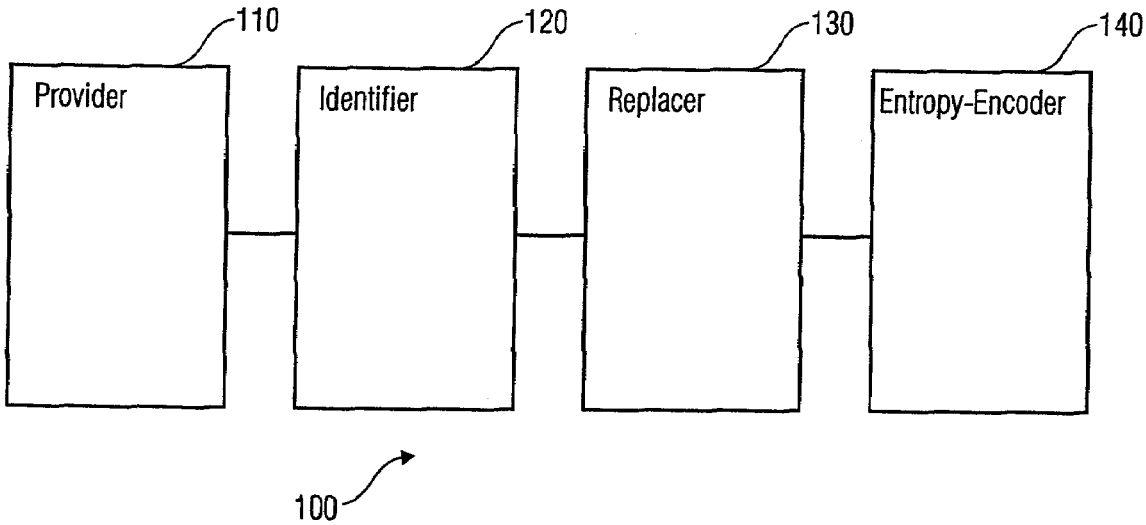
FIG. 2 shows a block diagram of a further embodiment of an apparatus for encoding digital audio data.

A further embodiment of the apparatus 100 for digital audio data is depicted in FIG. 2. FIG. 2 shows the provider 110, the identifier 120 as well as the replacer 130, as they were described with respect to FIG. 1. Furthermore, the embodiment of the apparatus 100 for encoding digital audio data depicted in FIG. 2 comprises an entropy encoder 140 for encoding digital data with a reduced bit rate. The two embodiments depicted in FIGS. 1 and 2 of the apparatus 100 can be operative to encode digital raw data, for example, PCM data (PCM=Pulse Code Modulation). The provider 110 can, therefore, be implemented as any source of audio data, for example, a CD player, extended by a means for realizing the psycho-acoustically encoding. The psycho-acoustically encoding is done per frequency band, which can be implemented, for example, by employing a filter in a filter bank within the provider. According to the embodiment depicted in FIG. 2, the apparatus 100 can comprise an entropy encoder 140, so the digital audio data with reduced bit rates can be entropy encoded, for example, with a Huffman code in order to comply with AAC or MP3 standards.

Figure 3:
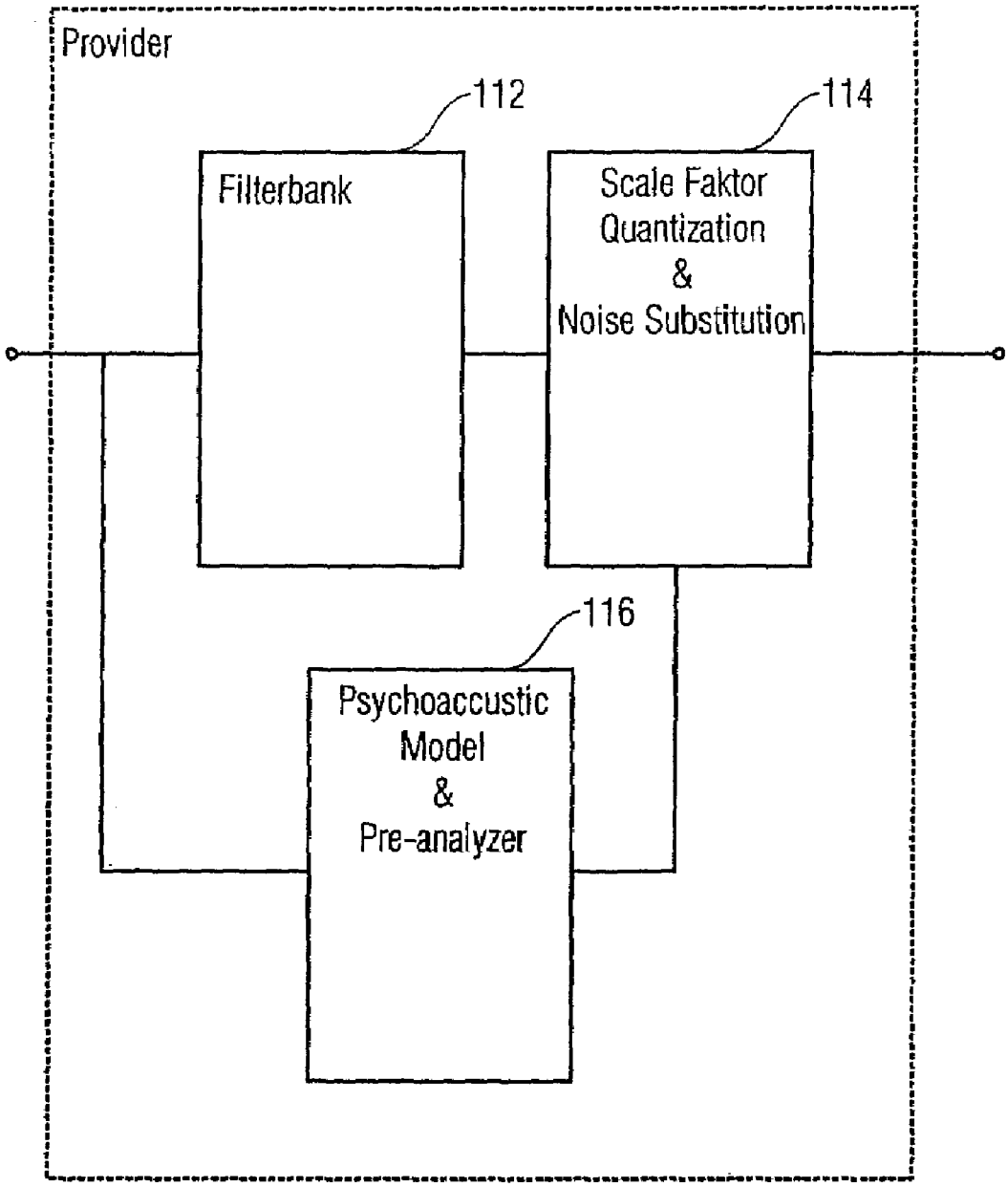
FIG. 3 shows an embodiment of an inventive provider.

FIG. 3 shows an embodiment of the provider 110. In this embodiment, the provider 110 comprises a filter bank 112, which transforms digital audio data into the frequency domain providing frequency coefficients per frequency band. The provider 110 further comprises a scale factor quantization and noise substitution block 114, which determines the scale factors and the quantization as well as the noise substitution based on the data, a psycho-acoustic model and pre-analyzer block 116 derived from the input digital audio data. The psycho-acoustic model and pre-analyzer block 116 determines from the digital input data as to which frequency bands can be substituted by noise right away and provides that information to the scale factor quantization and noise substitution block 114. Furthermore, the psycho-acoustic model provides data that allows for derivation of the scaling factors and the quantization. The pre-analyzer could analyze the data in the time domain and in another embodiment, it could analyze the data in the frequency domain in order to determine frequency bands that can be replaced with noise at a decoder. One method in order to determine these frequency bands is an analysis-by-synthesis, where basically all frequency bands are sequentially substituted by noise, the complete signal is synthesized again and a quality measure is taken. Running an iteration across all of the frequency bands can identify a frequency band with the lowest quality impact, which would then be chosen for replacement. This process will be detailed later on.

In another embodiment of the present invention, the provider 110 would acquire already-encoded data, for example, an MP3 file or AAC encoded data and would then utilize a decoder in order to remove the entropy coding. Once the entropy coding is removed, psycho-acoustically quantized data that may already contain noise replaced frequency bands, is available to be passed on by the provider 110 to the identifier 120. It is then a task of the identifier 120 to identify the frequency bands, pass on the psycho-acoustically quantized data to the replacer 130, where the according frequency bands are replaced.

Figure 4:
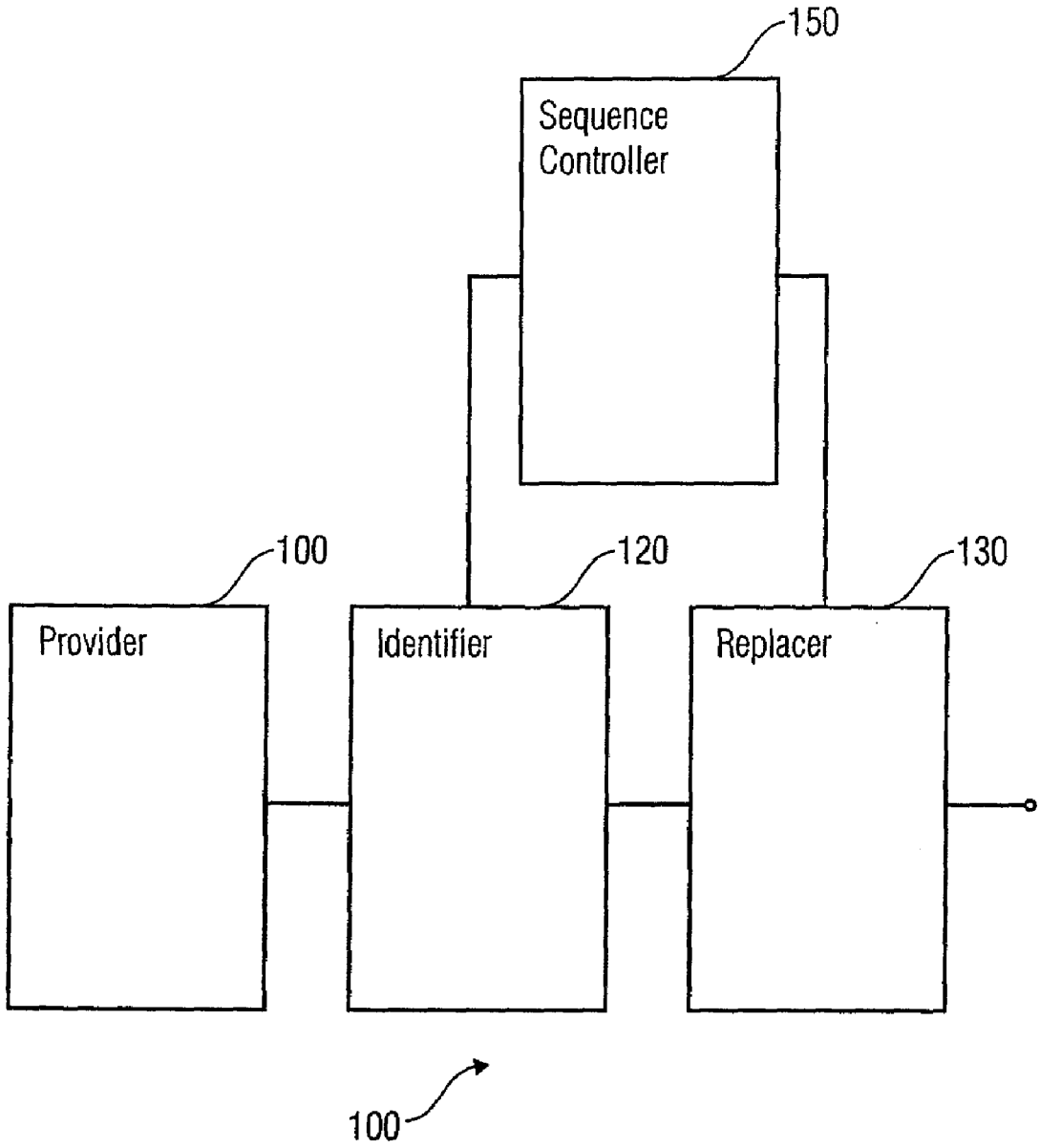
FIG. 4 shows a block diagram of another embodiment of an apparatus for encoding digital audio data.

In another embodiment, the apparatus 100 is required to reduce the bit rate of digital audio data to a certain target bit rate. An embodiment for this inventive apparatus 100 is depicted in FIG. 4. FIG. 4 shows again an embodiment of the apparatus 100 for encoding digital audio data, which is, at first, provided by a provider 110. The identifier 120 identifies the frequency bands, which are to be replaced by the replacer 130, where the identification is based on a selection criterion. The apparatus 100 in FIG. 4 further comprises a sequence controller 150, which is coupled to the identifier 120 and the replacer 130. Once a frequency band has been identified, the replacer 130 replaces the data in this frequency band by a synthesis parameter for the noise generator, upon which a new bit rate results. It is now the objective of the sequence controller 150 to adjust the selection criterion for the frequency bands to be replaced in a way that the target bit rate is achieved. In one embodiment, the sequence controller starts with a very soft selection criterion, resulting in a very low number of frequency bands being selected for replacement. If the resulting bit rate after the replacement is still higher than the target bit rate, the sequence controller needs to tighten the selection criterion.

Figure 5:
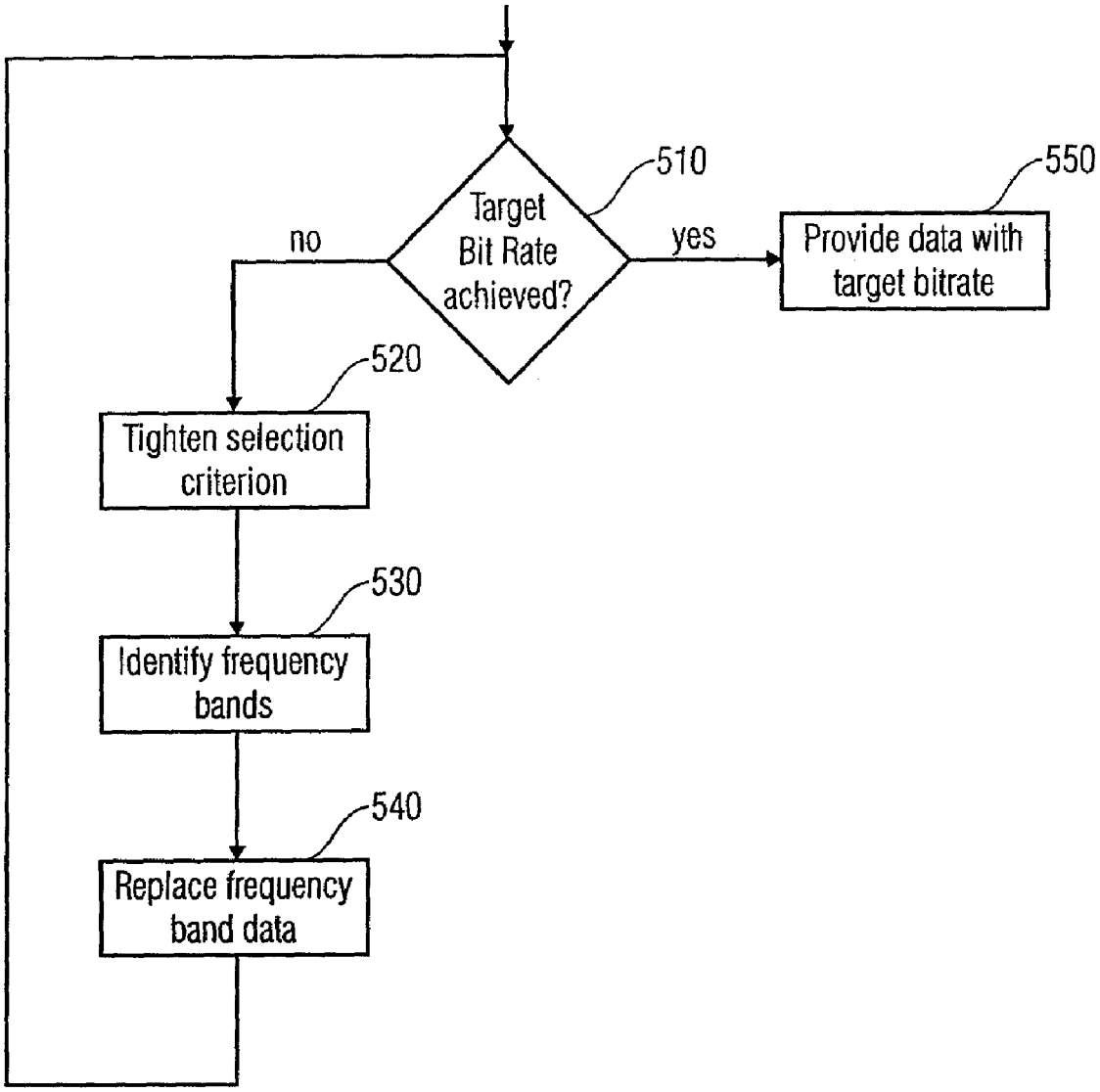
FIG. 5 shows a flowchart of an embodiment of a sequence controller method.

A flowchart of the iteration carried out to achieve the target bit rate is depicted in FIG. 5. The sequence controller 150 checks, in a first verification block 510, whether the target bit rate is achieved. If the target bit rate is not achieved, the sequence controller 150 tightens the selection criterion in a step 520 and passes the tightened selection criterion onto the identifier 120, upon which new frequency bands for replacement are identified in a block 530 and, finally, the replacer 130 replaces the new identified frequency bands as well in a step 540. After that, the sequence controller 150 again verifies as to whether the target bit rate has been achieved in a step 510. Once the target bit rate has been achieved, the data can be provided with the target bit rate in a step 550.

At the identifier 120, post analyzers can be operative in one embodiment in order to analyze the data according to a selection criterion. The post analyzer operates similar to the pre-analyzer mentioned as being in one embodiment of the inventive provider 110. Again, analysis-by-synthesis can be carried out by the post analyzer.

Figure 6:
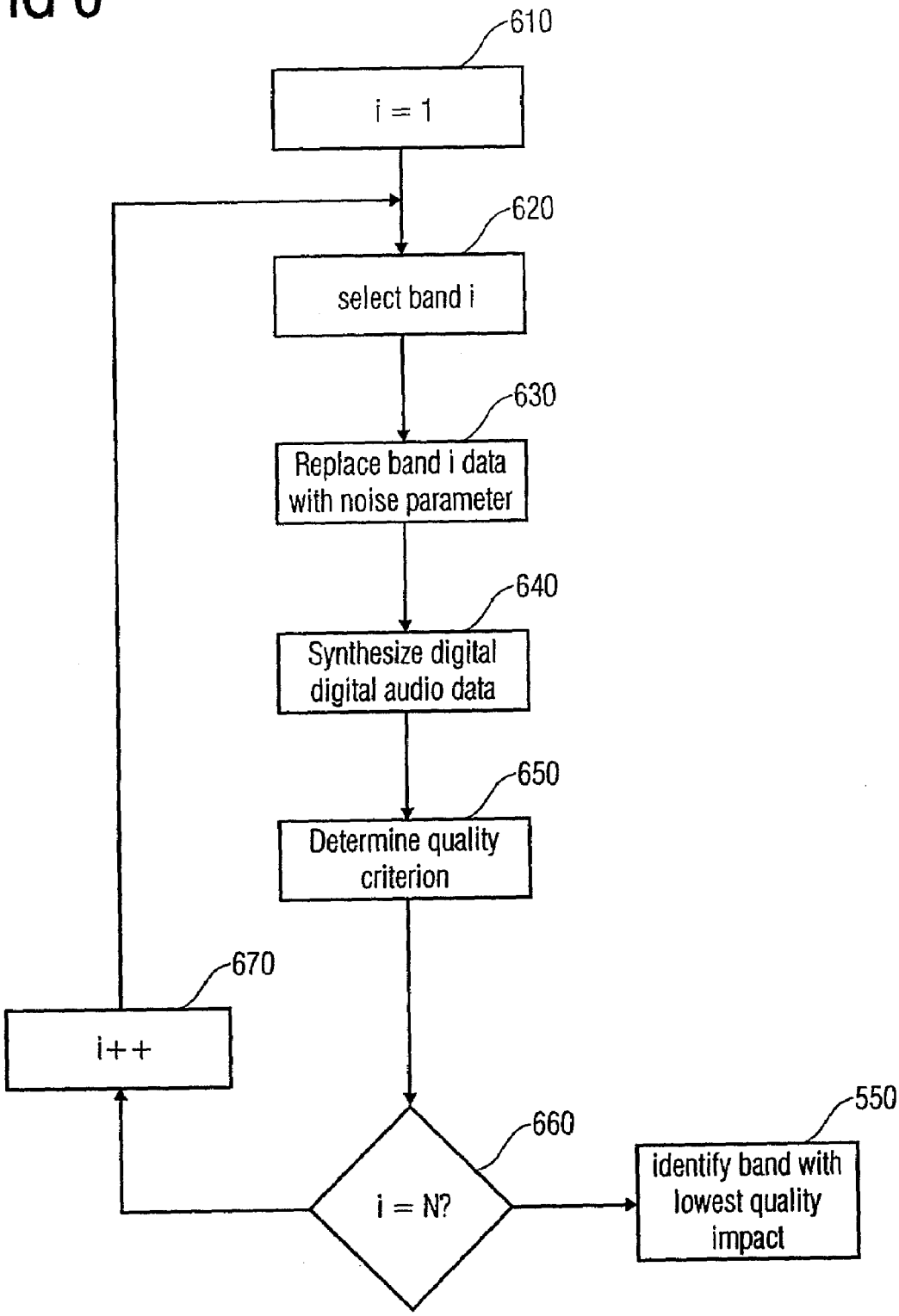
FIG. 6 shows a flowchart of an embodiment of an analysis-by-synthesis method.

FIG. 6 shows a flowchart of an embodiment of a method to carry out analysis-by-synthesis. In a first step 610, an iteration index i is initialized with value 1. In the embodiment depicted in FIG. 6, it is assumed that the digital audio data is divided into N sub-bands. In a step 620, a band is selected according to the iteration index, i.e. the selection process is started with the first frequency band. In a next step 630, the selected frequency band is replaced with the according noise parameter, upon which in step 640, the entire digital audio data is synthesized together. Once the data is synthesized, a quality criterion or a quality measure can be determined in step 650. This quality measure can then be stored together with the iteration index indicating the frequency band. In step 660, it is verified whether the iteration has been completed, i.e. if all frequency bands have been checked already and, if not, the iteration index is increased by one step in step 670 and the next band is selected again in step 620. Once the entire iteration process has been completed, i.e. if all N frequency bands have been tested, the frequency bands with the lowest quality impact can be chosen and be identified for replacement. The quality impact can be determined by traditional measures as, for example, a signal-to-noise ratio. Another measure would be a measure that is determined by a psycho-acoustically model, again determining the lowest quality impact for the human auditory system.

The criterion for noise substitution during the encoding process, as indicated in FIG. 3 at the provider 110 as well as the selection criterion carried out by the post-analyzer within the identifier 120 can basically refer to the same measure. However, the pre-selection criterion, as it is used in one embodiment at the provider, determines frequency bands within digital audio data, which do not harm the quality of the digital audio data, which is again determined by the psycho-acoustical model. Deferring from that objective, i.e. decreasing the quality and introducing an impact on the quality of the digital audio data considering the human auditory system, the post-analyzer at the identifier selects frequency bands. Although the pre-selection criterion and the selection criterion can refer to the same measure, they defer in their impact on the quality.

Measures that can be taken at the pre-analyzer as well as the post-analyzer being used as pre-selection criterion or selection criterion are, for example, a lowest tonality, a lowest or highest signal-to-noise ratio, a lowest or highest signal-to-mask ratio, i.e. taking into account the human auditory system properties, a lowest energy in a frequency band, a highest center frequency of a frequency band or a best stability in the time domain, i.e. lowest variability in a time period.

In another embodiment, the replacer 130 is adapted to replace frequency bands, which are consecutive frequency bands together with a single noise synthesis parameter, i.e. by replacing several frequency band data carrying out a higher bit rate reduction of the digital audio data.

While, in the state of the art, codec perceptual noise substitution is used to replace scaling factors judged to be noise-like before the actual quantization and coding step, noise substitution is used in embodiments of the present invention to reduce the bit rate. There are more useful cases for perceptual noise substitution than just merely replacing scale factor bands found to be noise-like in the perceptual model, as it is currently achieved by the state of the art. In embodiments of the present invention, perceptual noise substitution is employed as part of a constraints reduction apparatus or bit rate reduction apparatus in the more advanced constraints reduction method.

Figure 7:
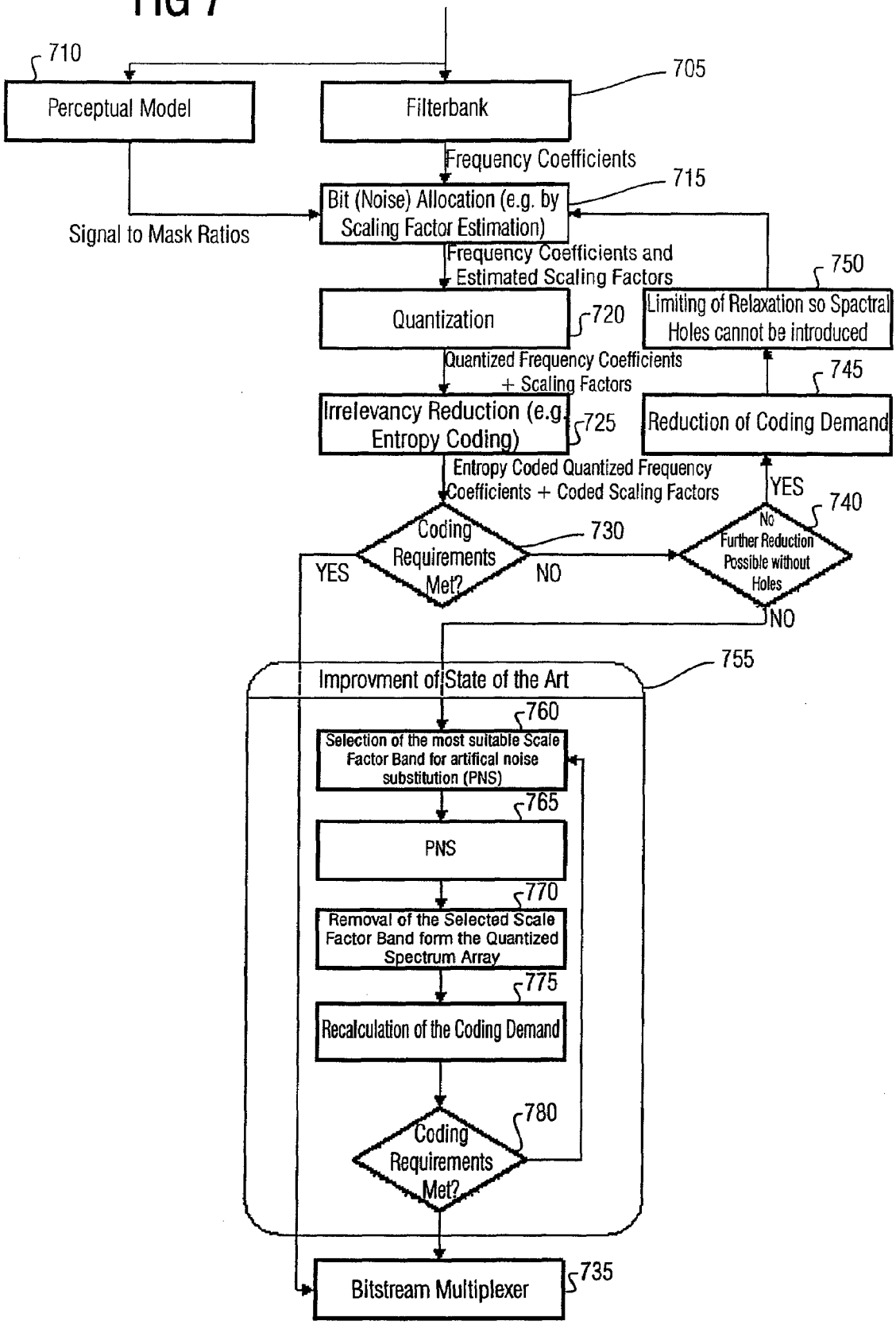
FIG. 7 shows a flowchart of an embodiment of a state of the art method extended by an embodiment of the inventive method.
Figure 8:
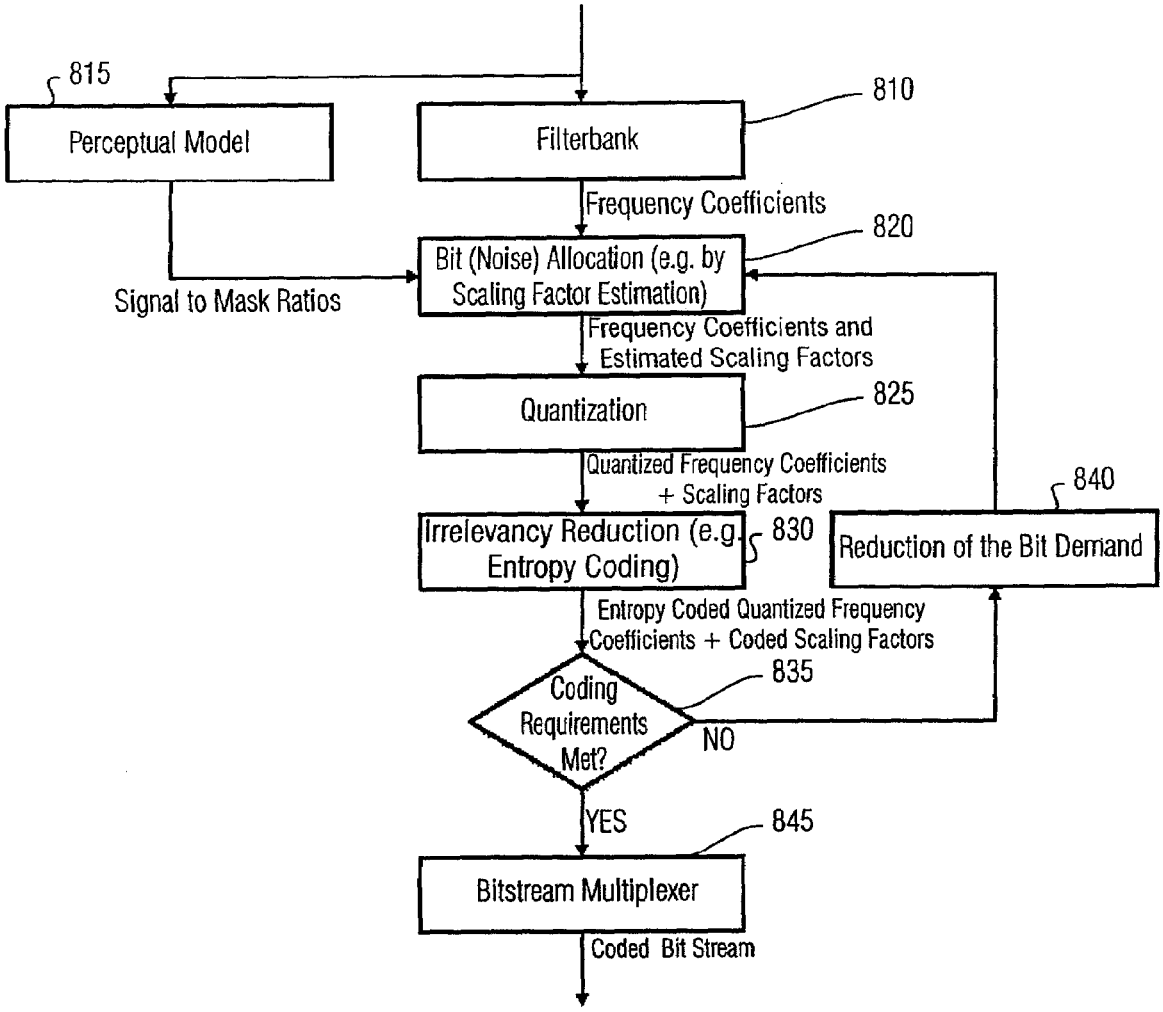
FIG. 8 shows a flowchart of the state of the art encoding process.
Figure 9:
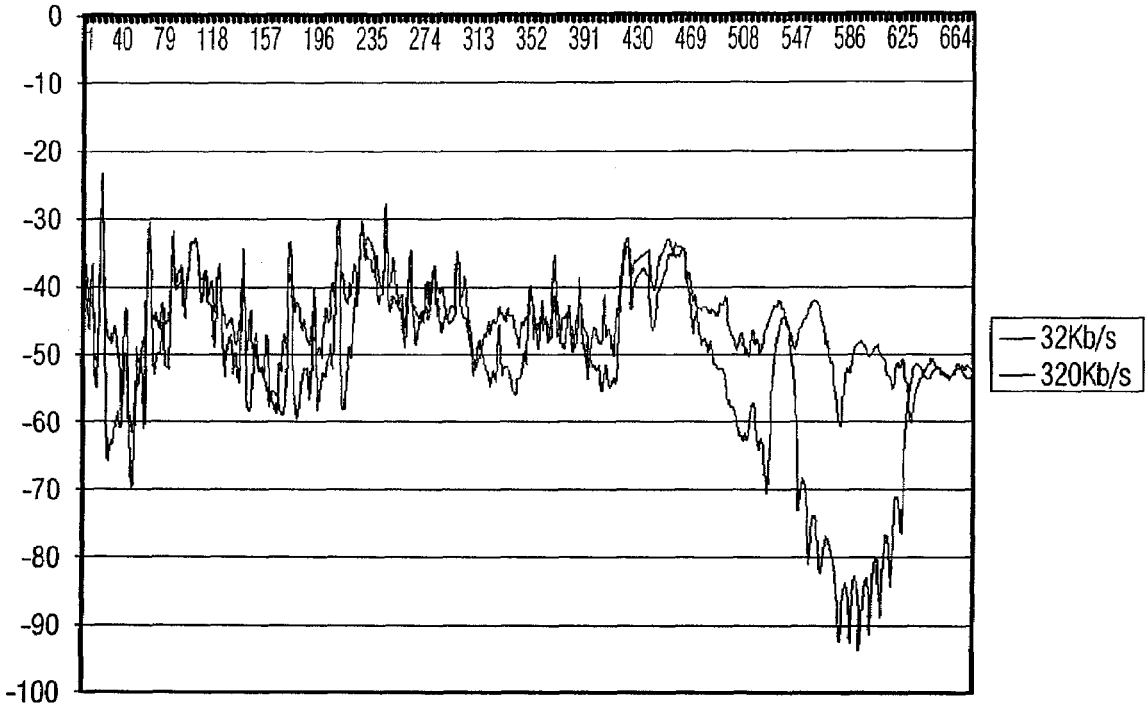
FIG. 9 shows two spectral diagrams of encoded digital audio data.

A full flow chart of the state of the art encoding process extended by an embodiment of the inventive method is shown in FIG. 7. FIG. 7 shows the input signal being input into a filter bank 705 and into a perceptual model 710. The frequency coefficients being output from the filter bank 705 are then input into a bit/noise allocation block 715, which is also connected to the perceptual model block 710. The bit/noise allocation block 715 is followed by a quantization block 720 and by an irrelevancy reduction block 725, which are similar to the bit/noise allocation block 820 and the quantization block 830 as explained in FIG. 8. After the irrelevancy reduction block 725, a code requirement verification is done in block 730. If the coding requirement is met, the entropy encoded quantized frequency coefficients and the coded spelling factors are input to a bit stream multiplexer 735 and the encoded data is available with the required bit rate. If the coding requirement, which is verified in the coding requirement block 730 is not met, another verification step is done in 740, which checks as to whether a further reduction of the bit rate is possible without introducing spectral holes. If it is possible to further reduce the bit rate without introducing spectral holes, the coding demand is reduced in block 745 and the relaxation is limited, so spectral holes cannot be introduced in a following step 750. The process is then repeated starting with the bit/noise allocation step 715.

This state of the art procedure is extended by an embodiment of an inventive method within the box 755 in FIG. 7. If, in the verification step 740 it is determined that no further reduction in the bit rate of the digital audio data is possible without introducing spectral holes, the procedure is followed by a selection block 760. The selection block 760 selects the most suitable scale factor band for artificial noise substitution, also called perceptual noise substitution. Once a proper frequency band has been identified, the perceptual noise is generated in a block 765 inserted into the digital data, where the selected scale factor band is removed from the quantized spectrum array in step 770 and the coding demand can be recalculated in step 775. After this, the coding requirement can be verified in step 780 and if the coding requirement is not met, it is returned to the step 760, i.e. the next frequency band is selected for perceptual noise substitution. Eventually, the process will terminate with a coding requirement that is met, upon which the bit stream can be multiplexed in a step 735 and the digital data is available with reduced bit rate.

As can be seen from FIG. 7, an embodiment of the present invention is, in the upper-part of the process flow, very similar to an advanced coding solution that can be found in the state of the art described above. The difference lies in the constraint reduction options, where embodiments of the present invention prevent the introduction of spectral holes. Instead of removing scale factor bands and introducing spectral holes, embodiments of the present invention solve the problem in a more effective way. Principally, in a first step, selection of the most appropriate scale factor bands, or a sub-set of frequency coefficients, for substitution with artificial noise in the decoder is carried out.

This selection can be done by various means, such as one of, or a multiple of, a scale factor band with the lowest tonality, a scale factor band with the lowest or highest signal-to-noise ratio, a scale factor band with the lowest or highest signal-to-mask ratio, a scale factor band with the lowest energy, a scale factor band with the highest center frequency, a scale factor band with the best stability in the time domain or any grouping of frequency coefficients fulfilling one or more of the just mentioned metrics.

It is noted that these means are just explanatory and other means known to a person skilled in the art, as they are within the scope and spirit of this invention.

After the selection has been carried out, selected scale factor bands or other grouping of frequency coefficients are coded, for example, with the perceptual noise substitution tool, meaning that the embodiments of the present invention remove the spectral content from the digital audio data and instead of the scaling factors for the band, for example, its approximate average energy is transmitted along with an appropriate flag telling the decoder to reconstruct said band with artificially-generated noise of approximately the same energy as transmitted in the bit stream.

In another embodiment of the present invention following the perceptual noise substitution coding, the bit demand of the replaced spectral coefficients can now be removed from the quantized spectrum bit demands and the total bit demands can be compared to the encoder constraints. If the constraints are still not met, the procedure continues until constraints are either met or all bands are coded with the perceptional noise substitution. Therefore, it is necessary to set a minimum constraint such that the perceptual noise substitution energy factors could be transmitted for all the bands. If it is desirable to reach such limits, it is possible to employ the removal of the perceptual noise substitution scale factors to reach even very high coding constraints. This could be achieved by iteratively removing most suitable perceptual noise substitution factors, where methods for evaluating such factors are known to a person skilled in the art, for example, like the selection of the lowest energy scale factor or the highest frequency scale factor, etc. The bit demand is then re-evaluated and the process is repeated until it satisfies the constraints or, respectively, all factors are set to zero.

Embodiments of the present invention provide the advantage that the introduction of spectral holes is effectively prevented, as artifacts connected to the spectral band shut downs or spectral holes, in a modern perceptual audio codec are circumventive, yielding a better quality of digital audio data with respect to the human auditory system.

One embodiment of the present invention is an audio coding apparatus based on frequency-based perceptual audio coding with a perceptual model, time-to-frequency mapping and quantization and an entropy coding block. Furthermore, coding can be based on the grouping of a plurality of frequency domain spectral coefficients to scale factor bands and quantizing them with irrelevancy reduction. In another embodiment, the plurality of frequency domain spectral coefficients can be treated in a manner proportional with the critical bands of the human auditory system and quantizing them with irrelevancy reduction. Another embodiment of the present invention comprises the transmission of said coefficients in a coded bit stream.

Moreover, an embodiment could make use of substitution of the scale factor band with the artificially-generated narrow band noise in the decoder without the need to transmit the spectral contents of a said scale factor band, where the coding constraint's evaluation methods can be based on just noticeable distortion measures calculated by a perceptual model and the values of the spectral coefficients. Embodiments of the present invention reduce the coding requirements in order to meet the coding constraints by substitution of the scaling factor bands with one of the methods described above. For example, a suitable scale factor band can be selected for reduction of coding requirements by determining the scale factor band with the most similarity to white noise, the scale factor band with the highest center frequency, the scale factor band with the lowest energy, the scale factor band with the highest signal-to-noise ratio, the scale factor band with the lowest signal-to-noise ratio, the scale factor band with the highest signal to just noticeable distortion energy ratio or the scale factor band with the lowest signal to just noticeable distortion energy ratio.

Depending on certain implementation requirements of the inventive methods, the inventive methods can be implemented in hardware or software. The implementation can be performed using a digital storage medium, in particular a disc, DVD or a CD having an electronically-readable control signal stored thereon, which operates with a programmable computer system, such that the inventive methods are performed. Generally, the present invention is, therefore, a computer program product with a program code stored on a machine-readable carrier, the program code being operative for performing the inventive methods when the computer program product runs on a computer. In other words, the inventive methods are, therefore, a computer program having a program code for performing at least one of the inventive methods when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A hardware apparatus for encoding digital audio data with a reduced bit rate, comprising:

a provider of psycho-acoustically quantized digital audio data with a bit rate being higher than the reduced bit rate, wherein the provider includes a noise substitution process for replacing spectral data in a pre-selected frequency band by an inserted parameter of the noise substitution process, the pre-selected frequency bands being identified by a pre-selection criterion, the noise substitution process being carried out instead of psycho-acoustically quantizing the digital audio data, wherein the provider includes a pre-analyzer for analyzing digital audio data according to the pre-selection criterion for pre-selecting the frequency band for insertion of a noise substitution parameter, or a post-analyzer for analyzing psycho-acoustically quantized data in a frequency band according to the selection criterion for identifying the frequency band for psycho-acoustically quantized data replacements, wherein the pre-analyzer or the post-analyzer are operative to utilize the pre-selection criterion or the selection criterion, the pre-selection criterion being different from the selection criterion, the pre-selected frequency band being different from the identified frequency bands;

an identifier for identifying the frequency band according to a selection criterion, the selection criterion being such that an impact on the quality of the digital audio data when the data in the identified frequency band is replaced by generated noise is smaller than the impact on the quality of the digital audio data, which would arise when data in a different frequency band is replaced by generated noise, and a replacer for replacing data in the identified frequency band of the digital audio data by a noise synthesis parameter, the noise synthesis parameter requiring a smaller amount of data than the data in the identified frequency band, the digital audio data comprising the reduced bit rate.

2. The apparatus of claim 1, wherein the provider is adapted for providing psycho-acoustically quantized digital audio data per frequency band, the frequency band being determined by a filter in a filter bank.

3. The apparatus of claim 1, further comprising an entropy encoder for encoding the digital audio data comprising the reduced bit rate.

4. The apparatus of claim 1, wherein the psycho-acoustically encoded digital data includes entropy encoded quantized spectral data and wherein the provider includes an entropy decoder for entropy decoding the psycho-acoustically encoded digital audio data for providing the psycho-acoustically quantized spectral data and wherein the identifier and the replacer are operative to process the entropy decoded psycho-acoustically quantized digital audio data.

5. The apparatus of claim 1, wherein the pre-analyzer utilizes the pre-selection criterion and the post-analyzer utilizes the selection criterion corresponding to one of or a combination of the group of a lowest tonality, a lowest or highest signal-to-noise ratio, a lowest or highest signal-to-mask ratio, a lowest energy, a highest central frequency, a best stability in the time domain or a lowest variability in the time domain.

6. The apparatus of claim 1, further comprising a sequence controller for controlling the identifier and the replacer, the sequence controller comparing the reduced bit rate with a target bit rate, adapting the selection criterion such that more frequency bands are identified for replacement by noise synthesis parameters when the reduced bit rate is higher than the target bit rate.

7. The apparatus of claim 1, wherein the replacer is adapted for replacing data of a plurality of frequency bands and for replacing data of consecutive frequency bands by a noise synthesis parameter.

8. The apparatus of claim 1, wherein the provider is operative to provide psycho-acoustically quantized data from encoded digital audio data, the encoded digital audio data being encoded according to ISO/IEC 14496.

9. The apparatus of claim 3, being adapted for encoding digital audio data with reduced bit rate according to ISO/IEC 14496.

10. A method for encoding digital audio data with a reduced bit rate, comprising:

providing psycho-acoustically quantized digital audio data with a bit rate being higher than the reduced bit rate, the providing including a noise substitution process for replacing spectral data in a pre-selected frequency band by an inserted parameter of the noise substitution process, the pre-selected frequency bands being identified by a pre-selection criterion, the noise substitution process being carried out instead of psycho-acoustically quantizing the digital audio data, wherein the providing comprises pre-analyzing digital audio data according to the pre-selection criterion for pre-selecting the frequency band for insertion of a noise substitution parameter, or post-analyzing psycho-acoustically quantized data in a frequency band according to the selection criterion for identifying the frequency band for psycho-acoustically quantized data replacements, wherein the pre-selection criterion or the selection criterion is utilized, the pre-selection criterion being different from the selection criterion, the pre-selected frequency band being different from the identified frequency bands;

identifying the frequency band according to a selection criterion, the selection criterion being such that an impact on a quality of the digital audio data when the data in the identified band replaced by generated noise is smaller than the impact on the quality of the digital audio data, which would arise when data in a different frequency band is replaced by generated noise, and replacing data in the identified frequency band of the digital audio data with noise synthesis parameter, the noise synthesis parameter requiring a smaller amount of data than the data in the identified frequency band, the digital audio data comprising the reduced bit rate.

11. A digital storage medium having stored thereon a computer program comprising program codes for performing a method for encoding digital audio data with a reduced bit rate, comprising:

providing psycho-acoustically quantized digital audio data with a bit rate being higher than the reduced bit rate, the providing including a noise substitution process for replacing spectral data in a pre-selected frequency band by an inserted parameter of the noise substitution process, the pre-selected frequency bands being identified by a pre-selection criterion, the noise substitution process being carried out instead of psycho-acoustically quantizing the digital audio data, wherein the providing comprises pre-analyzing digital audio data according to the pre-selection criterion for pre-selecting the frequency band for insertion of a noise substitution parameter, or post-analyzing psycho-acoustically quantized data in a frequency band according to the selection criterion for identifying the frequency band for psycho-acoustically quantized data replacements, wherein the pre-selection criterion or the selection criterion is utilized, the pre-selection criterion being different from the selection criterion, the pre-selected frequency band being different from the identified frequency bands; and identifying the frequency band according to a selection criterion, the selection criterion being such that an impact on a quality of the digital audio data when the data in the identified band replaced by generated noise is smaller than the impact on the quality of the digital audio data, which would arise when data in a different frequency band is replaced by generated noise, and replacing data in the identified frequency band of the digital audio data with noise synthesis parameter, the noise synthesis parameter requiring a smaller amount of data than the data in the identified frequency band, the digital audio data comprising the reduced bit rate, when the program code runs in a computer.

* * * * *